US006880704B2

(12) United States Patent
Bredahl

(10) Patent No.: US 6,880,704 B2
(45) Date of Patent: Apr. 19, 2005

(54) PACKAGING WRAPPER FOR PAPER TISSUES

(75) Inventor: Gunnar Bredahl, Tyskland (DE)

(73) Assignee: SCA Hygiene Products AB, Sverige (SE)

( * ) Notice: Subject to any disclaimer, the term of this patent is extended or adjusted under 35 U.S.C. 154(b) by 200 days.

(21) Appl. No.: 10/243,872

(22) Filed: Sep. 16, 2002

(65) Prior Publication Data

US 2003/0052034 A1 Mar. 20, 2003

Related U.S. Application Data

(60) Provisional application No. 60/318,892, filed on Sep. 14, 2001.

(51) Int. Cl.[7] ..... B65D 69/00

(52) U.S. Cl. ..... 206/494; 206/233; 206/812

(58) Field of Search ..... 206/494, 440, 206/460, 205, 812, 823, 233; 221/36, 37, 210; 383/203, 205, 207; 229/87.05, 80.5, 76

(56) References Cited

U.S. PATENT DOCUMENTS 3,737,095 A * 6/1973 Derauf ..... 229/232
4,574,952 A * 3/1986 Masui ..... 206/494
5,046,640 A * 9/1991 Carroll ..... 221/213
5,165,545 A * 11/1992 Focke et al. ..... 206/494
6,454,096 B1 * 9/2002 Kondoh et al. ..... 206/494

FOREIGN PATENT DOCUMENTS

| | | |
|---|---|---|
| DE | 199 42 659 A1 | 4/2001 |
| EP | 0 293 360 A2 | 5/1988 |
| JP | A 10-234615 | 9/1998 |

* cited by examiner

*Primary Examiner*—Anthony D. Stashick
*Assistant Examiner*—J. Gregory Pickett
(74) *Attorney, Agent, or Firm*—Young & Thompson

(57) ABSTRACT

A packaging wrapper, for handkerchiefs, baby care, household or other hygiene paper tissues and including a front wall, a rear wall, a first side wall and a second side wall and two end walls, with a reclosable opening in the area of the front wall, a lid mainly including at least part of the front wall covering the reclosable opening, with the lid having an outer side and an inner side, where the lid on its inner side is equipped with a fastening element adapted to successively engage the upper-most lying paper tissue as one after the other of the paper tissues is taken out of the wrapper.

19 Claims, 4 Drawing Sheets

PACKAGING WRAPPER FOR PAPER TISSUES

This application claims benefit of U.S. Provisional Appl. 60/318,892, filed Sep. 14, 2001.

FIELD OF THE INVENTION

The invention relates to a packaging wrapper for paper tissues such as handkerchiefs, comprising a wrapping forming front, rear, side and end walls surrounding the wrapper contents, with a reclosable opening cover by lid.

BACKGROUND OF THE INVENTION

Paper tissues for handkerchiefs etc. are normally folded and stacked a few, typically nine or ten, in a plastic foil wrapper. These can be carried in a pocket or a handbag, or be placed upon a desk or shelf.

These wrappers nowadays are most often equipped with a reclosable flap, enabling the user to open the wrapper, take out a handkerchief and reclose the wrapper to keep the remaining handkerchiefs protected from dirt and moisture.

The opening can be made in many different ways.

EP 0,392,224 shows a wrapper with an opening just in the edge between the front wall and the side or end wall, with an extraction opening as a cut-out under the reclosable flap. The user will have to grip the handkerchief via the cut-out in this narrow opening.

EP 0,401,621 shows a wrapper with an opening formed by a lid, separated from a side wall and a minor part of the front wall by cuts and perforations and a cut-out in a side wall. A handkerchief can be taken out fairly easy, but the user must when gripping it, separate it from the next one. To close the wrapper, the lid is put down and fastened with a reclosable flap that reaches around the side wall to be adhered to the rear wall.

EP 0,132,250 shows a wrapper where there is no need for a reclosable flap, as an opening is created in a side wall by two overlapping plastic foil pieces, the uppermost one of which has a convex shape to better cover the opening. The overlapping pieces are connected at their ends. The convex part can be lifted off the other foil piece to form an opening where the user can withdraw a handkerchief. This will form a rather narrow opening where the user will have to separate the wanted handkerchief from the next one.

EP 0,961,736 shows a wrapper where two overlapping plastic foil pieces from an opening in a side wall, where the ends are welded together to give stability to the wrapper, but the openable parts of the side wall are separated from the ends by cuts.

The opening is enabling the user to withdraw a wanted handkerchief, but still he will have to separate it from the next one.

German utility patent G 91.06.555 shows a wrapper with an opening at the end wall where the user can withdraw a handkerchief. The handkerchiefs are folded in a special way to ease the unfolding of it after it has been withdrawn from the wrapper; first Z folding and then doubling and redoubling the other direction.

Still there is a need for a wrapper where the withdrawal of a handkerchief or other paper tissue is facilitated for the user, enabling him to withdraw a handkerchief in an easy and hygienic way, without having to touch the neighboring handkerchiefs.

There is also a need for a wrapper that enables the user to withdraw and unfold a handkerchief in a single operation, preferably using only one hand.

SUMMARY OF THE INVENTION

It is an object for the present invention to make a paper tissue wrapper with a simplified handling of opening and paper tissue withdrawal.

The invention concerns a packaging wrapper, for handkerchiefs, baby care, household or other hygiene paper tissues as a pack contents, comprising a wrapper surrounding the paper tissues made of a blank, by means of which a front wall, a rear wall, a first side wall and a second side wall and two end walls are formed, with a reclosable opening in the area of the front wall, a lid mainly comprising at least part of the front wall covering the reclosable opening, with said lid having an outer side and an inner side.

This object is accomplished by the fact that the lid on its inner side is equipped with a fastening means adapted to successfully engage the upper-most lying paper tissue as one after the other of the paper tissues is taken out of the wrapper.

According to a preferred embodiment the wrapper is held closed, after it has been opened for the first time, by a closing flap that is being provided, having one end securely bonded to the outer side of the lid to be releasably fastened to the first side wall by the action of a pressure-sensitive adhesive that is applied to at least a part of the free end of the closing flap.

A preferred variant of the invention is where the lid is formed from the front wall by two perforations extending along at least part of the front wall in the vicinity of the end walls, and an overhang to the area of the first side wall.

Another preferred variant of the invention is where the reclosable opening has a length of at least half, preferably at least two thirds, and even more preferably, four fifths, of the length of the front wall in the direction starting from the overhang.

Another preferred variant of the invention is where the wrapper is stabilized by edge parts extending inwards the reclosable opening from the end walls and from the first side wall.

Preferably, the fastening means is chosen from the group of a patch of pressure-sensitive adhesive, a patch of hook material, one or more holes enabling the pressure-sensitive adhesive used to adhere the closing flap to the outer side of the lid to be exposed to the inner side of the lid.

A preferred variant of the invention is where the fastening means is placed to cooperate with the paper tissue to be pulled in an area where the paper tissue has been strengthened, preferably by embossing or gluing.

The paper tissues are preferably folded and packed in the wrapper such that when being pulled in an area presented to a user they will open up and be at least partly unfolded.

The lid can be connected to any of the side or end walls of the wrapper.

A preferred variant of the invention is where the lid is formed from the front wall by two perforations running along at least part of the front wall in the vicinity of the end walls or side walls, and an overhang to the area of the first side wall or end wall, respectively.

DETAILED DESCRIPTION OF THE INVENTION

Figure 1:
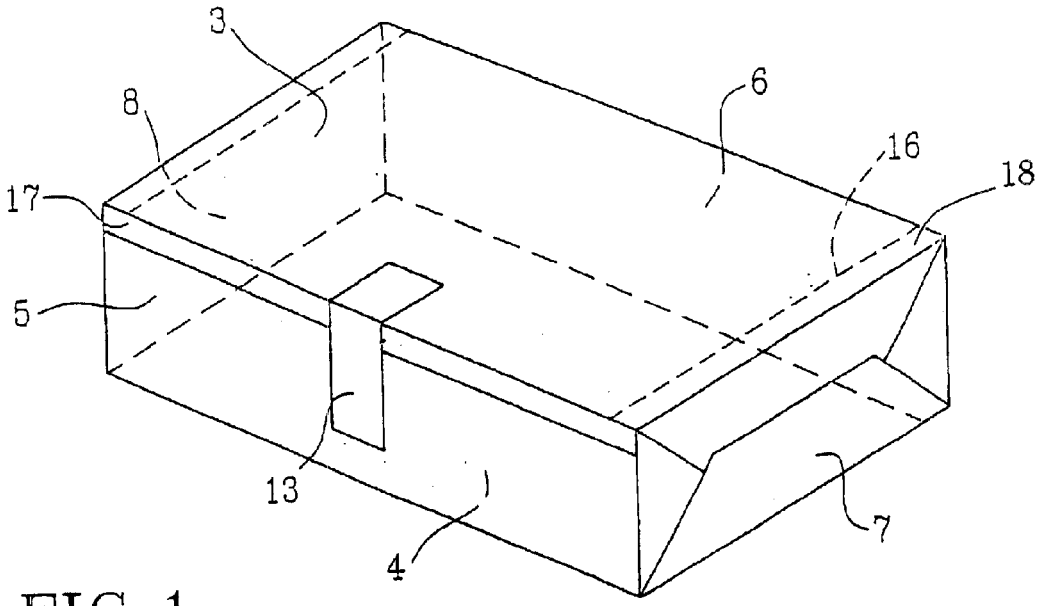
FIG. 1 a perspective view of a wrapper for holding a stack of handkerchiefs in a closed position FIG. 2 a perspective view of a wrapper for holding a stack of handkerchiefs in an open position, showing the fastening means on the inner side of the lid FIG. 3 a view of a handkerchief in its fully opened state, indicating the fold lines used to prepare it for easy unfolding FIG. 4 a view of a handkerchief as it is folded to lie in the wrapper FIG. 5 a perspective view of a wrapper for holding a stack of handkerchiefs in a position as opened by a user opening the lid of the wrapper, making the top handkerchief quarter open FIG. 6 a view of a handkerchief as it is further opened to half open by lifting in the free corner by the user FIG. 7 an alternate way of folding a handkerchief FIG. 8 an alternate wrapper with the lid hinged on the edge towards the end wall
Figure 2:
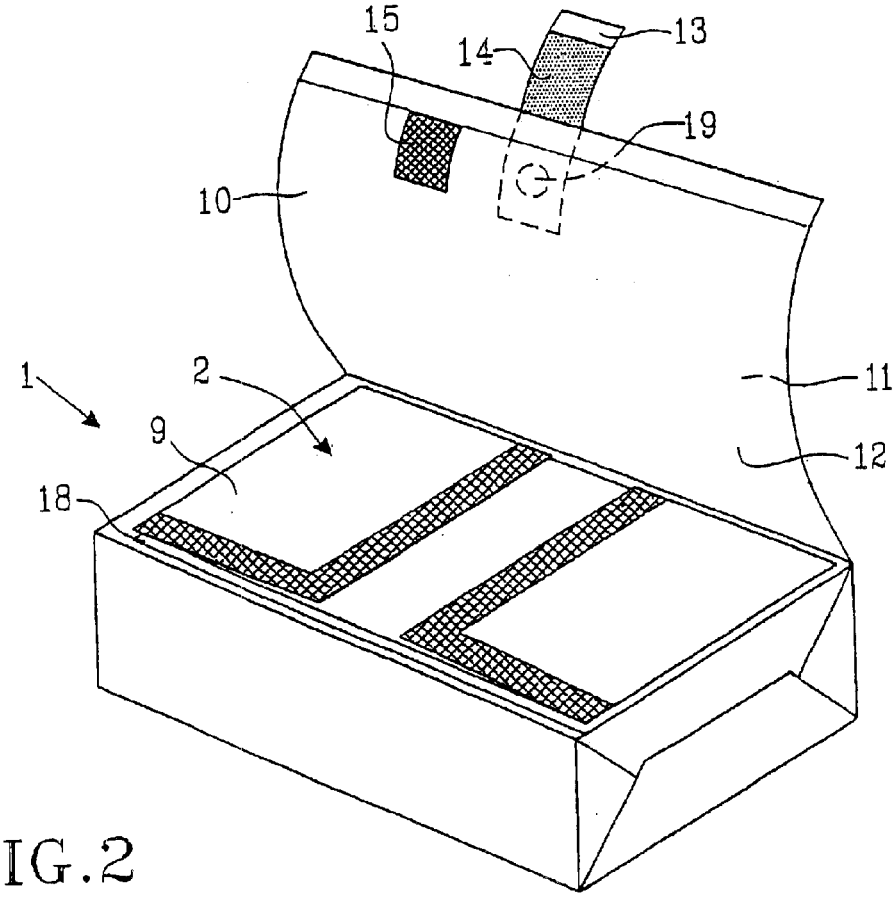

The packaging wrapper shown in a closed state in FIG. 1 and in an open state in FIG. 2 is made from for example a blank of thin plastic foil being cut and folded to make up a front wall 3, a rear wall 4, a first elongated side wall 5 and a second elongated side wall 6 and two end walls 7, 8. Two adjoining walls will also define an edge between them. Each end wall 7, 8 is welded or glued together, from overlapping flaps extending from the neighboring walls.

The front wall 3 will open up as a lid 10 to make a reclosable opening 9 where paper tissues can be withdrawn from the wrapper and is equipped with a closing flap 13 to hold down the lid 10 after it has been opened for the first time.

The front wall 3 is perforated along perforation lines 16 near the edges to the end walls 7, 8. These perforation lines 16 will, at least partly, be torn open when the wrapper 1 is opened for the first time. The perforation lines 16 run a few millimeters from the edges, to leave edge parts 18 that help stabilize the wrapper and protect it from dirt entering and soiling the paper tissues.

Also the first elongated side wall 5 is equipped with an extension in the form of an edge part 18 to stabilize the wrapper.

The lid 10 has a slight overhang 17 that will partly cover the first elongated side wall 5 when the wrapper 1 is in a closed position. This will also stabilize the lid 10.

Before the wrapper 1 is opened for the first time the overhang 17 is preferably fastened to the first elongated side wall 5 with a weak glue or a lacquer to make the wrapper tight against dirt.

The closing flap 13 is at one end permanently fastened to the lid 10 and at the other end the closing flap 13 can be releasably connected to the first elongated side 5. At the outer-most part of the closing flap 13 is provided an adhesive-free grip tab.

The plastic foil used for making the wrapper 1 will normally be printed. Preferably areas of the plastic foil that are to be welded or glued to each other should be without printing, as the adhesion of the glue or the weld will be lowered on printed areas.

Instead of using plastic foil for wrapper blank material, also paper or thin aluminum foil could be used.

The lid 10 is on its inner side 12 equipped with a patch of fastening means 15. The fastening means 15 will engage the paper tissue which is lying upper-most in the pack of folded tissues, to lift at least a part of it. The fastening means 15 should preferably be placed on the free end of the lid 10 to make the lifting action large enough to be effective. The fastening means 15 is preferably made of a patch of a pressure-sensitive adhesive, that should be tacky enough to be able to hold the tissue for lifting it, but not too tacky as it should be easy enough to dislodge the paper tissue from the fastening means 15 as the paper tissue is completely withdrawn. The adhesive Technomelt Q 8407-24 from the German company Henkel is an example of an adhesive that is suitable. The fastening means 15 could alternatively consist of a hook material, as that used for a hook-and-loop fastener. The slightly uneven surface of the paper tissue will be caught by the hooks, to let the paper tissue be lifted. It could even consist of adhesive holding the closing flap 13 on the outer side 11 of the lid 10, acting through one or more apertures 19 in the lid 10 under the closing flap 13.

It is advantageous, if the patch of fastening means 15 engages the paper tissue in an area of the paper tissue, which has relatively higher surf ace strength than other areas of the paper tissue, eg where it is embossed or glued. This will lessen the risk of damaging, or even tearing, the surface of the paper tissue.

Paper tissue for this type of use, as handkerchiefs, is normally made of more than one ply. Common is two, three or four plies that are glued or embossed together, mostly only at the border, to achieve a soft and skin-friendly inner area and a not quite so soft border area, that is stronger and holds the plies together.

To really take advantage of the lifting action effected by the fastening means 15 the paper tissues should be able to unfold automatically when the lid 10 is lifted. The paper tissues should preferably be folded according to the fold lines indicated in FIG. 3. First the substantially square paper tissue is Z folded at fold lines 101 and 102, in any order, to get a 'doubled' paper tissue. After that, the tissue is folded at fold line 103, and then the quadrupled paper tissue is folded according to fold lines 104*a* and *b*, which at that moment will constitute one folding line. The resulting folded paper tissue will look like the example in FIG. 4, where the folded paper tissue is turned so that the 'double edge' 21, is at the bottom and a free corner 22 at the top.

Figure 4:
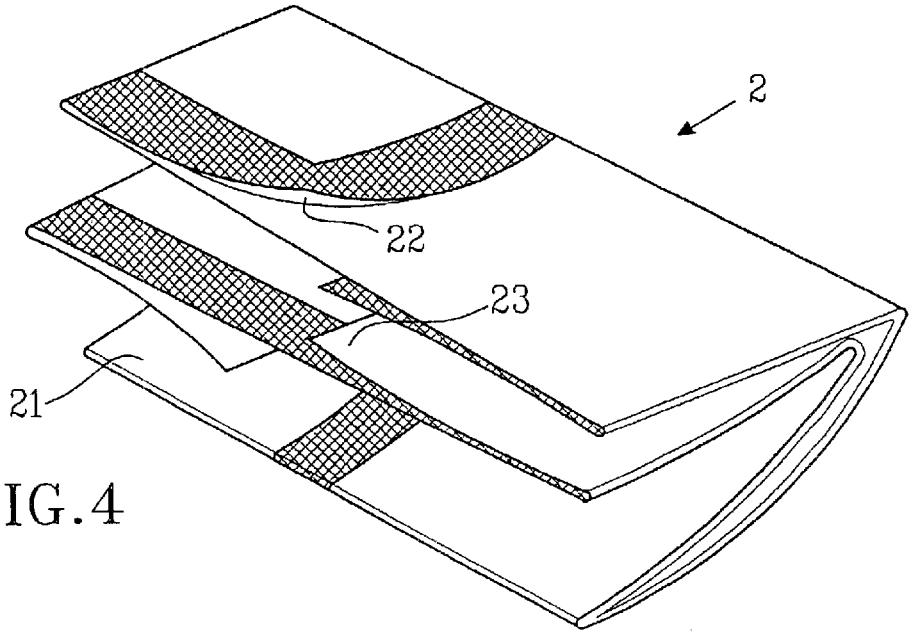

A stack of paper tissues folded to look like the paper tissue in FIG. 4 is placed in the wrapper, with the 'double edge' 21 at the bottom. When the lid 10 is opened for the first time, and each subsequent time, the fastening means 15 will engage the top surface of the upper-most paper tissue, preferably at the free corner 22 to lift it, and a part of the paper tissue. As the lid 10 is more opened, as in FIG. 5, a second free corner 23 will come to view.

Figure 3:
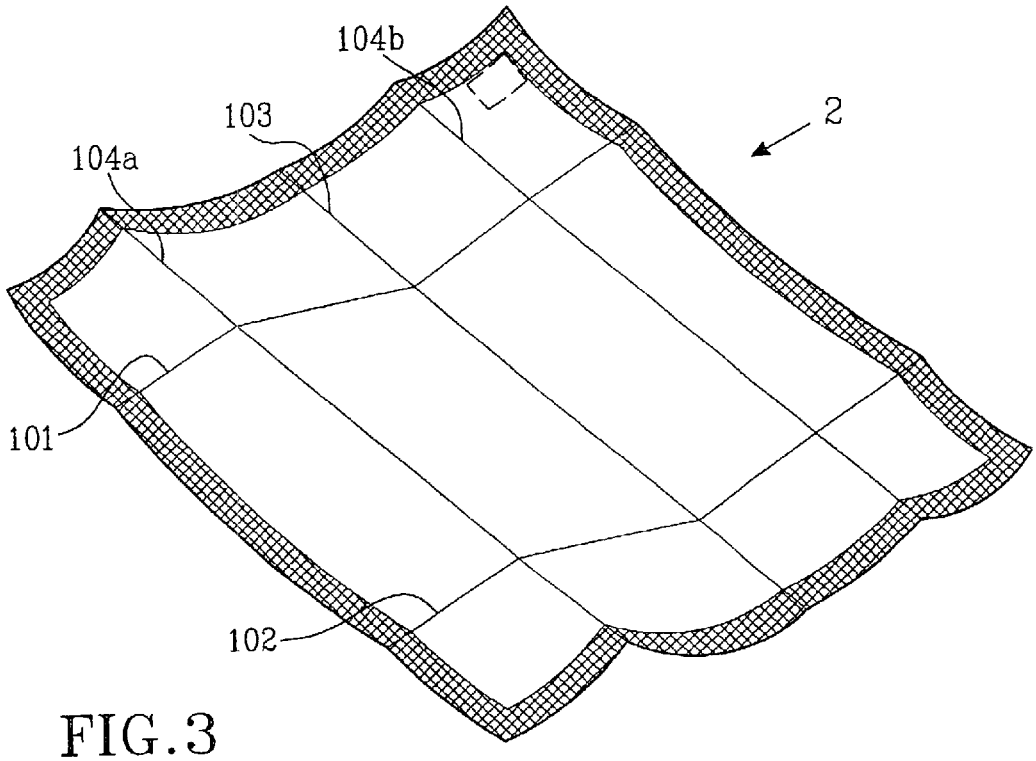
Figure 6:
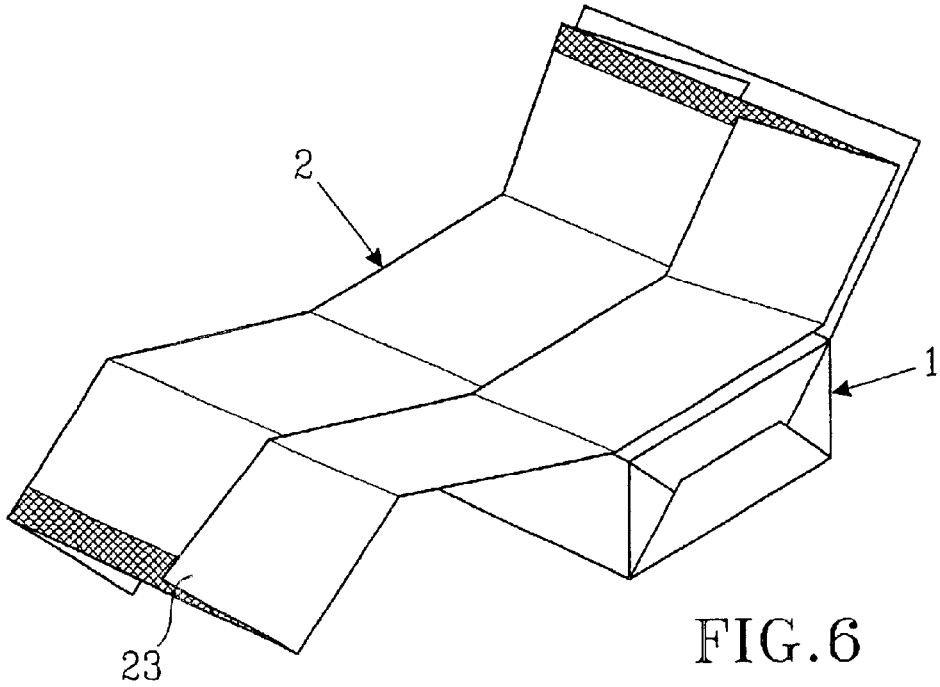

When this second free corner 23 is pulled the folded paper tissue will partly unfold to the position shown in FIG. 6, and continued pulling at a second fee corner 23 will completely unfold the paper tissue to look like FIG. 3, and will make the fastening means 15 disengage from the paper tissue.

Thus the paper tissue easily can be unfolded to be ready to use.

Figure 7:
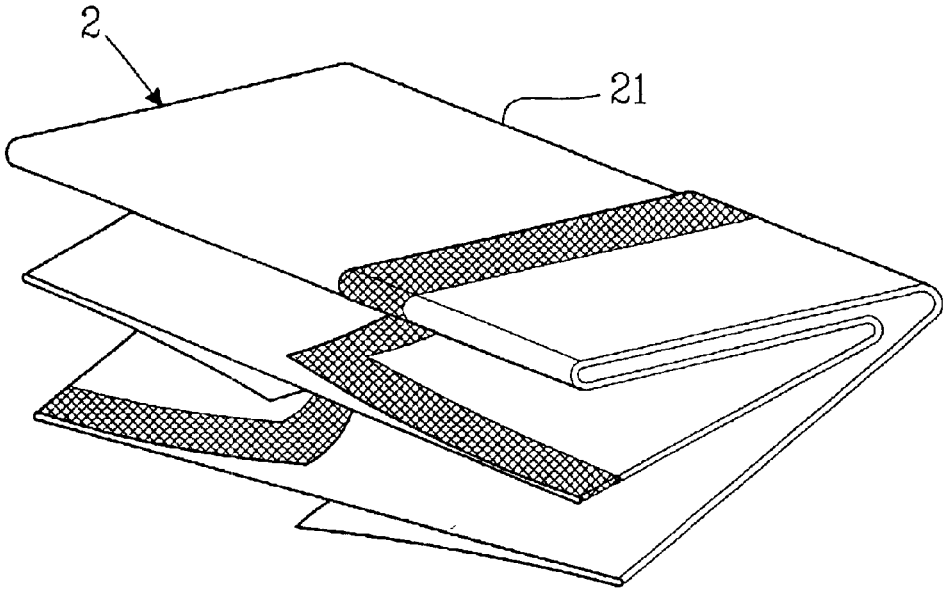

Another way of stacking the folded paper tissue is according to FIG. 7 where the 'double edge' 21 is at the top. When this folded paper tissue is pulled by the action of the fastening means 15 it will open up partly and present a tissue corner a user can pull to extract the paper tissue. Pulling this will not result in a fully opened paper tissue as when the 'double edge' 21 is at the bottom, as shown in FIG. 4, but still will result in a partly opened paper tissue that easily is shaken out to fully opened.

Other ways of folding and stacking of the paper tissues can of course be used, but will not take full advantage of the possibilities of the invention.

Figure 8:
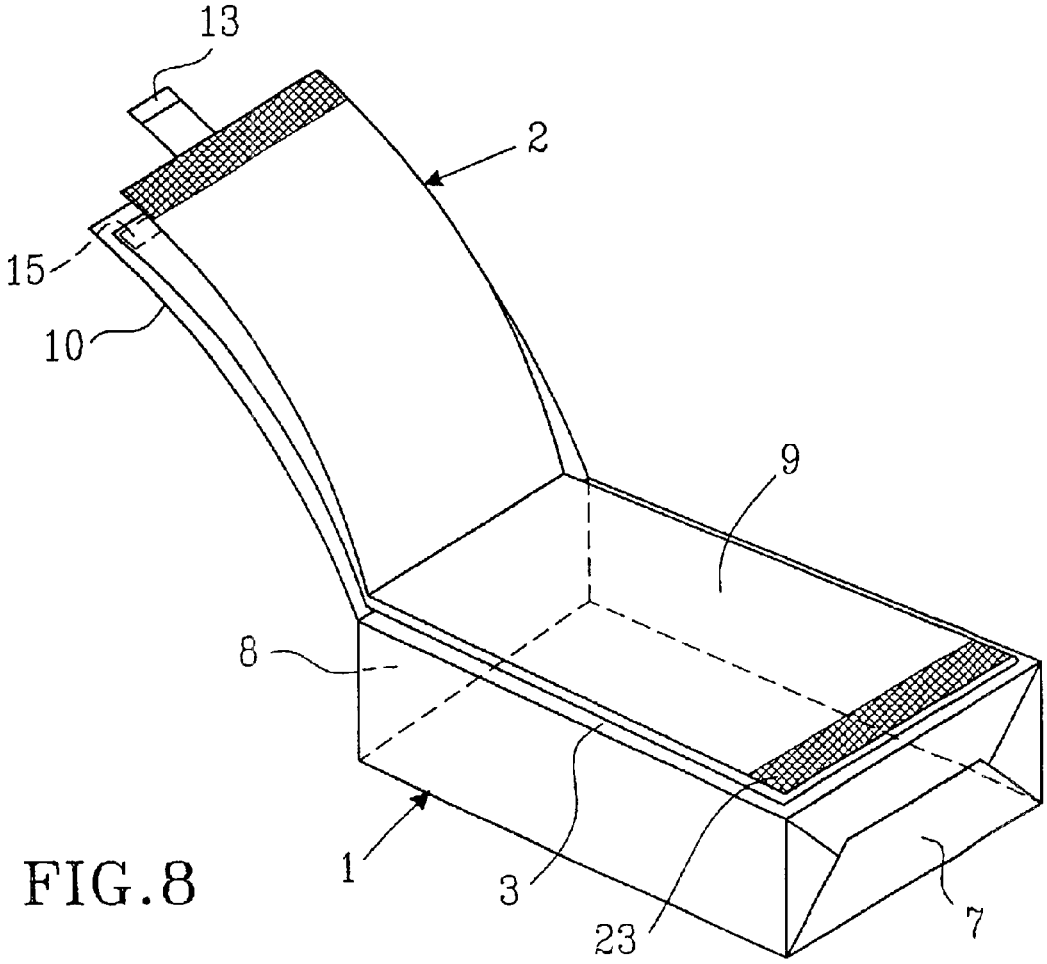

An alternative way of arranging the wrapper 1 is briefly shown in FIG. 8. In this alternative the lid 10 is connected to the second end wall 8 so that it is opened from the first end wall 7 towards the second end wall 8. The fastening means 15 will then lift the paper tissue a considerable distance to a very wide-open presentation. To fit this alternative the paper tissue should be folded differently from in FIG. 4, instead having its last fold as indicated in FIG. 8.

The invention is thus based on the fastening means 15. To take full advantage of this, the lid 10 should be able to fold back more or less all the way, creating a reclosable opening 9 of the total front wall 3 length, to let the unfolding paper tissue fall flat over.

Figure 5:
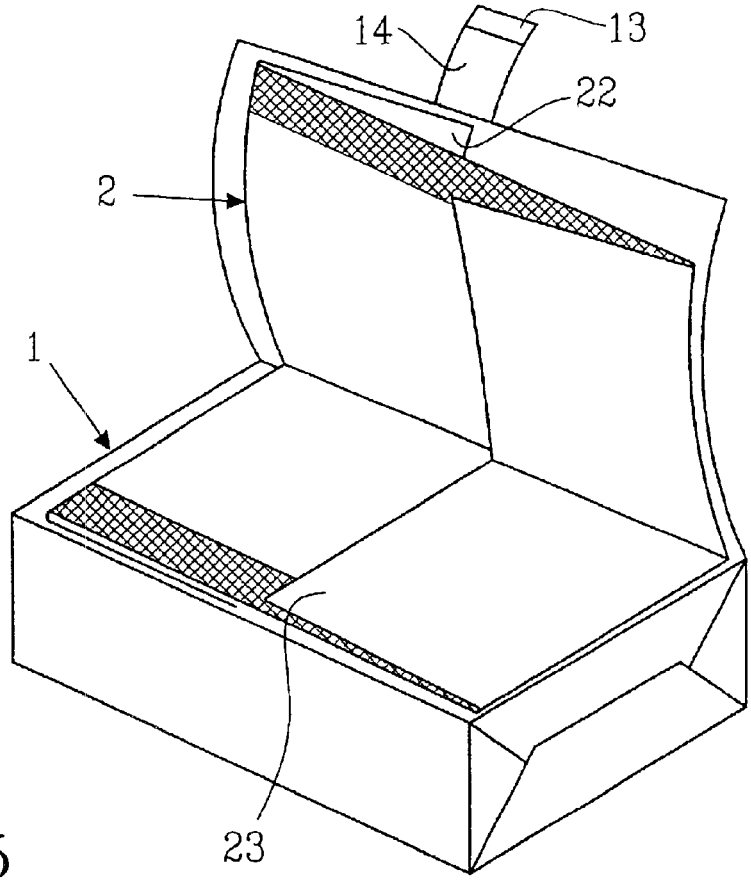

However, even without the lid 10 fully opened, it will easily be possible to get a good grip on the second free corner 23 to pull the paper tissue to fully unfold, as can be inferred from FIG. 5.

Thus, it normally will be satisfactory when the reclosable opening 9 has half the length of the front wall 3. Preferably, it will be two thirds, and even more preferably, four fifths of the length of the front wall 3.

What is claimed is:

1. A packaging wrapper, for handkerchiefs, baby care, household or other hygiene paper tissues as pack contents, comprising a wrapper made of a blank surrounding the paper tissues by means of which a front wall, a rear wall, a first side wall, and a second side wall and two end walls are formed, with a reclosable opening in the area of the front wall, a lid mainly comprising at least part of the front wall covering the reclosable opening, with said lid having an outer side and an inner side; said lid on its inner side being equipped with a fastening means adapted to successively engage the upper-most lying paper tissue as one after the other of the paper tissues is taken out of the wrapper; said fastening means being placed to cooperate with the paper tissue to be pulled in an area where the paper tissue has been strengthened.

2. The packaging wrapper according to claim 1, wherein the area of the paper tissue has been strengthened by embossing or gluing.

3. The packaging wrapper according to claim 1, further comprising a closing flap having one end securely bonded to the outer side of the lid to be releasably fastened to the first side wall by the action of a pressure-sensitive adhesive that is applied to at least a part of the free end of the closing flap.

4. The packaging wrapper according to claim 3, wherein the fastening means comprises one or more holes enabling the pressure-sensitive adhesive used to adhere the closing flap to the outer side of the lid to be exposed on the inner side of the lid.

5. The packaging wrapper according to claim 1, wherein the lid is formed from the front wall by two perforations extending along at least part of the front wall in the vicinity of the end walls, and an overhang to the area of the first side wall.

6. The packaging wrapper according to claim 5, wherein the reclosable opening has a length of at least half of the length of the front wall.

7. The packaging wrapper according to claim 5, wherein the reclosable opening has a length of at least two thirds of the length of the front wall.

8. The packaging wrapper according to claim 5, wherein the reclosable opening has a length of four fifths of the length of the front wall.

9. The packaging wrapper according to claim 1, wherein the wrapper is stabilized by edge parts extending inwards of the reclosable opening from the end walls and from the first side wall.

10. The packaging wrapper according to claim 1, wherein the fastening means comprises a patch of pressure-sensitive adhesive.

11. The packaging wrapper according to claim 1, wherein the fastening means comprises a patch of hook material.

12. The packaging wrapper according to claim 1, wherein the paper tissues are folded and packed in the wrapper such that when being pulled in an area presented to a user they will open up and be at least partly unfolded.

13. A packaging wrapper, for handkerchiefs, baby care, household or other hygiene paper tissues as pack contents, comprising a wrapper made of a blank surrounding the paper tissues by means of which a front wall, a rear wall, a first side wall, and a second side wall and two end walls are formed, with a reclosable opening in the area of the front wall, a lid mainly comprising at least part of the front wall covering the reclosable opening, with said lid having an outer side and an inner side; said lid being equipped with a fastening means adapted to successively engage the upper-most lying paper tissue as one after the other of the paper tissues is taken out of the wrapper; a closing flap having one end securely bonded to the outer side of the lid to be releasably fastened to the first side wall by the action of a pressure-sensitive adhesive that is applied to at least a part of the free end of the closing flap; and said fastening means comprising one or more holes enabling the pressure-sensitive adhesive used to adhere the closing flap to the outer side of the lid to be exposed on the inner side of the lid.

14. The packaging wrapper according to claim 13, wherein the lid is formed from the front wall by two perforations extending along at least part of the front wall in the vicinity of the end walls, and an overhang to the area of the first side wall.

15. The packaging wrapper according to claim 14, wherein the reclosable opening has a length of at least half of the length of the front wall.

16. The packaging wrapper according to claim 14, wherein the reclosable opening has a length of at least two thirds of the length of the front wall.

17. The packaging wrapper according to claim 14, wherein the reclosable opening has a length of four fifths of the length of the front wall.

18. The packaging wrapper according to claim 13, wherein the wrapper is stabilized by edge parts extending inwards of the reclosable opening from the end walls and from the first side wall.

19. The packaging wrapper according to claim 13, wherein the paper tissues are folded and packed in the wrapper such that when being pulled in an area presented to a user they will open up and be at least partly unfolded.

* * * * *